United States Patent [19]

Torre

[11] 4,276,842

[45] Jul. 7, 1981

[54] DEVICE FOR REGULATING THE TRANSPORT MECHANISM IN SEWING MACHINES

[75] Inventor: Giancarlo D. Torre, Biassono, Italy

[73] Assignee: Rockwell-Rimoldi, S.p.A., Milan, Italy

[21] Appl. No.: 95,181

[22] Filed: Nov. 16, 1979

[30] Foreign Application Priority Data

Jan. 5, 1979 [IT] Italy ..... 19061 A/79

[51] Int. Cl.[3] ..... D05B 27/12

[52] U.S. Cl. ..... 112/322; 112/235

[58] Field of Search ..... 112/322, 318, 311, 320, 112/235

[56] References Cited

U.S. PATENT DOCUMENTS

| | | | |
|---|---|---|---|
| 2,730,977 | 1/1956 | Hayes et al. | 112/322 |
| 3,485,193 | 12/1969 | Landwehr et al. | 112/322 |
| 3,960,097 | 6/1976 | Block | 112/322 |
| 3,994,248 | 11/1976 | Marjorio | 112/322 |

*Primary Examiner*—H. Hampton Hunter

[57] ABSTRACT

A regulating device for the upper wheel type workpiece transport mechanism in sewing machines. The transport wheel is rotatably driven and carried by a tubular support pivotably mounted on the machine. An eccentric roller having an indicating arm extending therefrom is in operative contact with the tubular support and with one end of the indicating arm disposed in operative association with a graduated scale defined by a plurality of stops for selectively locating the indicating arm. By moving the latter to any one of the stops, the eccentric roller is effective in changing the operating position of the transport wheel so that it can accommodate workpieces which vary in thickness and with generally the same amount of pressure being applied to each workpiece.

4 Claims, 3 Drawing Figures

DEVICE FOR REGULATING THE TRANSPORT MECHANISM IN SEWING MACHINES

BACKGROUND OF THE INVENTION

The present invention pertains to a pressure control device for the workpiece transport mechanism in sewing machines in which said mechanism is of the type that is adapted to maintain contact with the workpiece during the performance of its intended function. Additionally the invention relates to a means for increasing or decreasing the amount of pressure with which the transport mechanism engages a workpiece to effect its advancement through the sewing area of the sewing machine.

As is well known to those conversant in the art, the transport mechanisms of sewing machines are disposed and function in a manner so as to influence a particular portion of a workpiece, that generally consists of superposed layers of fabric, so as to effect its advance through the sewing zone in synchronization with other active elements of said sewing machine operatively associated therewith. More particularly, the transport mechanisms are formed by elements including the well known feed dog or such elements as rotatably driven wheels or discs that are caused to act on a workpiece intermittently and in a direction which will permit the desired formation of stitches in said workpiece.

It is also well known that these transport mechanisms whether they be of the feed dog or disc type, can be caused to influence only one of the layers of fabric of a workpiece or they can be utilized in combination with the feed dog type being effective on the lower layer of fabric and the disc type on the upper layer.

Generally, more than one transport mechanism is provided on sewing machines which are utilized to assemble workpieces that define articles of clothing so that when advancing or transporting said workpiece through the sewing zone, the various layers of material comprising such articles will be maintained in their intended alignment with one another.

When utilizing more than one transport mechanism, the lower layer of the workpiece is acted upon the mechanism which is caused to periodically project above the work surface of the machine and cooperate with the machine's presserfoot to effect advance of said workpiece. The transport mechanism of the upper layer being generally of the disc type engages its respective layer at a position lower than the presser foot and performs its function in opposition to the machine's work surface that is fixedly positioned.

Regardless of which type of transport mechanism that is utilized, the pressure which it exerts on the upper layer to effect its advance tends to compress it and the forces of this compression becomes greater in the event of an increase in thickness and softness of said upper layer.

When the forces of compression by the transport mechanism become what is considered excessive, they frequently create an undesireable condition of marking the workpiece with the mark extending the entire distance along that portion of the workpiece which was acted upon by said mechanism.

With workpieces formed from particularly soft fabrics such as cord or velvet, the amount of compression by the transport mechanism becomes appreciable relative to the thickness of the workpiece and the amount by which the upper layer is advancd with respect to the lower layer is caused to be increased and the mark produced by the transport mechanism becomes more pronounced and in many instances results in a permanent mark which cannot be removed. This increase in the amount the upper layer is caused to advance relative to the lower layer, can be attributed to the deeper penetration of the transport mechanism into the upper layer which alters both the degree of friction between the two layers that are in contact with one another, and the effective amplitude of the advancing motion of the transport mechanism. For practical and economic reasons it is not possible to continuously adjust the rate of advance of a workpiece and the pressure exerted by the transport mechanism on the upper layer in order to adapt the latter to the thickness and the particular type of fabric forming the workpiece which is being processed.

In order to alleviate the above described disadvantages devices are known for selectively adjusting the height of the transport mechanism so that the pressure with which they act on a workpiece can be controlled within satisfactory limits. Such known devices usually consist of a regulating screw which is arranged to oppose the action of the biasing means of the transport mechanism and it is quite obvious that such devices would be inconvenient as well as impractical when a series of workpieces being sewn vary in thickness from one to another.

An object of the present invention is to provide a device for regulating the pressure with which the transport mechanism engages a workpiece without altering the intended function of said mechanism and which can be quickly and easily adjusted to satisfactorily accommodate a series of workpieces which have thicknesses that vary from one to another.

SUMMARY OF THE INVENTION

The regulating device according to the invention comprises a so-called adjustable limiting means that is operatively connected to the transport mechanism in a manner so as to oppose the biasing forces thereof. The limiting means includes a graduated stop memeber with a pivotably mounted indicating arm operatively associated therewith which includes a means on one end thereof for selectively locating the indicating arm in any one of a plurality of positions provided on the stop member. The plurality of positions at which the indicating arm can be set permit an operator to increase or decrease the amount of pressure with which the transport mechanism is caused to engage a workpiece. By a particular position of the indicating arm on the stop member, the operator knows the amount of pressure to which a workpiece is being subjected by the transport mechanism and in the event of a change of thickness of the next workpiece the operator simply moves said indicating arm to another position which will provide the proper amount of pressure for that particular thickness of workpiece.

The regulating device comprising the invention is considered a definite advance in the art for it permits advancement of a workpiece through the sewing zone without subjecting it to excessive pressure by the transport mechanism and eliminates the aforementioned problem of marking said workpiece. Additionally, a particular advantage of the device is that it requires only a minimum amount of time by the operator to regulate the pressure with which the transport mechanism engages a workpiece so as to satisfactorily accommodate workpieces that vary in thickness.

These and other objects and advantages of the present invention will become more fully apparent by reference to the appended claims and as the following detailed description proceeds in reference to the figures of drawing wherein:

DESCRIPTION OF THE PREFERRED EMBODIMENT

Figure 1:
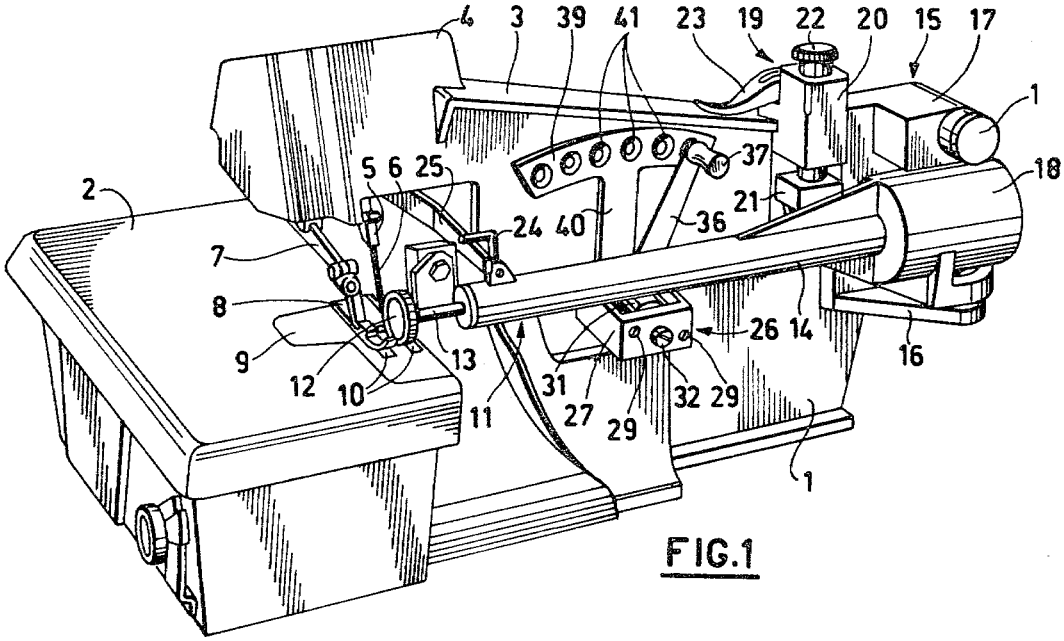
FIG. 1 is a perspective view of a portion of a sewing machine showing the device according to the invention applied thereto.

Now referring to the figures of drawing, enough of a sewing machine is shown in FIG. 1 to serve as a basis for a detailed description of the invention applied thereto. The sewing machine includes amoung its various parts, a base 1 having a flat planner surface 2 for supporting a workpiece during the sewing cycle. Extending upwardly from the base 1 the machine includes a frame element 3 that is adapted to support the head of the sewing machine which is identified by numeral 4. The head 4 houses the conventional and well known elements that include a needle bar 5 having a needle 6 carried on its lower end and a presser bar 7 which supports the machine's presser foot which is depicted by numeral 8.

The head 4 locates these known elements above the planar surface 2 and in alignment with a conventional needle plate 9 that defines the sewing zone and which is provided with the usual elongated openings that extend in the direction of sewing. As is well known to those conversant in the sewing art, these elongated openings serve to permit the machine's feed dog 10 to periodically project therethrough and cooperate with the presser foot 8 to effect advance of the lower layer of fabric of the workpiece.

An upper transport device generally indicated by numeral 11 is located above the planar surface 2 and includes a rotatably driven wheel member 12 that is disposed in operative association with the needle plate 9 so as to effect advance of the upper layer of fabric of the workpiece and maintain the same in alignment with the lower layer. The combination of the feed dog 10 and the wheel member 12 define the sewing machine's complete transport apparatus with which the present invention now to be described is operatively associated.

Although the regulating device of the present invention is shown and described as being operatively connected to a rotatably driven wheel type of upper transport device, it should be understood that such a regulating device would be equally effective upon an upper transport device having a configuration like that of a feed dog of the lower transport device.

As shown in FIG. 1 the wheel member 12 is fixed on one end of a rotatably driven shaft 13 which extends outwardly from one end of a tubular support 14. The opposite end of this tubular support 14 is pivotably mounted in a support bracket 15 so as to provide a means whereby the wheel member 12 can be selectively moved away from the sewing zone and also permit the wheel 12 to automatically rise or descend during the sewing cycle so as to compensate for variations in the thickness of a workpiece.

The support bracket 15 is attached to the frame element 3 by any suitable means not shown and includes lower and upper plate members 16 and 17 respectively between which a cylindrical housing 18 is mounted. This cylindrical housing 18 supports that end of the tubular support 14 most remote from the wheel member 12 and has a conventional drive mechanism therein (not shown) for effecting the required rotation of said wheel member 12 during the performance of its intended function.

The upper plate member 17 has a conventional adjustable biasing means mounted thereon which is identified generally by numeral 19 and serves to continuously urge the wheel member 12 into contact with the upper layer of fabric of the workpiece. This biasing means includes a coil spring (not shown) that is housed within a support block 20 so as to be in operative association with a push rod 21 extending outwardly from said support block in a manner whereby its outer end is in pressing engagement with the tubular support 14. The force with which the push rod 21 engages the tubular support 14 can be increased or decreased as desired by means of a threaded knob 22 which is assembled in the upper end of the support block 20 in a manner so as to engage the coil spring contained therein.

Additionally this biasing means 19 includes a lever 23 which serves to release the push rod 21 from its contact with the tubular support 14 so that the latter and the wheel member 12 carried thereon can be selectively displaced from their operating positions.

Figure 2:
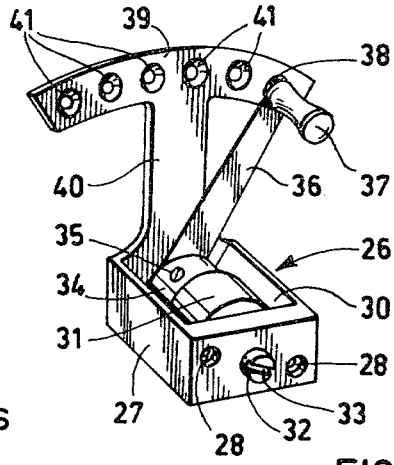
FIG. 2 is a perspective view of the device in FIG. 1 and on an enlarged scale to show further detail thereof.

A linking arm 24 is mounted on that end of the tubular support 14 adjacent the wheel member 12 and is operatively associated with a lever 25 which serves to manually raise the presser foot thereby providing a means for simultaneously displacing or returning said presser foot and wheel member 12 to their operating positions. As shown in FIG. 1 the frame element 3 has a regulating apparatus attached thereto which is identified generally by numeral 26 and provides the means according to the invention for controlling the amount of pressure with which the wheel member 12 engages a workpiece. Further detail of this apparatus is shown in FIG. 2 and it includes a body portion 27 which is of box-like configuration and defines a support structure. The body portion 27 is provided with holes 28 which serve as a means for its attachment to the frame element 3 by means of screws 29. The body portion 27 of the apparatus is assembled to the frame element 3 immediately below the tubular support 14 and being of box-like configuration the internal area thereof is identified by numeral 30. A limiting member 31 is mounted within the body portion 27 so as to be in operative contact with the tubular support 14. This limiting member is assembled on a shaft 32 which is pivotably mounted in the body portion 27 in a manner whereby the ends of said shaft 32 project beyond opposed end surfaces of said body portion within which they are journaled. As shown in FIGS. 1 and 2 that end of shaft 32 which projects beyond the limits of the forward end surface is provided with a screwdriver slot 33, the purpose of which will be further described hereinafter.

The limiting member 31 of the preferred embodiment defines an eccentric roller; however, it should be understood that other elements could perform the same function such as an arcuated lever, an eccentric segment or a cam in the form of a disc. Rotative movement in one direction or the other of the limiting member 31 with the shaft 32 on which it is fixed, will raise or lower the tubular support 14 as desired which in turn will change the position of the wheel member 12 relative to the needle plate 9 with which it cooperates during the peformance of its intended function. A collar 34 is mounted on the shaft 32 in contiguous relation with the limiting member 31 and is fixed thereon by means of a setscrew 35. This collar 34 is provided with an upwardly directed indicating arm 36 which is fabricatd from any suitably material that can be flexed manually. The upper end of the indicating arm 36 is provided on one side thereof with a laterally extending knob 37 and on the opposite with a laterally extending detent 38 which is disposed in axially alignment with said knob 37.

That side of the upper end of the indicating arm 36 from which the detent 38 extends is operatively associated with an arcuated plate element 39 that forms the upper end of a vertical arm 40. The lower end of this vertical arm 40 is fixed to the body portion 27. The arcuated plate member 39 is provided with a plurality of stops defining holes 41 which are evenly spaced along the length thereof and provide a means for selectively locating the indicating arm 36 by positioning the detent 38 in any one of said holes 41.

The combination of the arcuated plate member 39 and its holes 41 provide a graduated scale for selectively locating the indicating arm 36, and by means of the latter's operative connection with the tubular support 14, the wheel member 12 can be raised or lowered so as to accommodate workpieces which vary in thickness.

It should now be understood that contact between the limiting member 31 and the tubular support 14 is maintained by the biasing means 19 which provides the necessary opposing force so that the wheel member 12 will satisfactorily perform its intended function in any one of the plurality of selectable positions at which it is capable of operating.

The operating distance or space between the wheel member 12 and the needle plate 9 is initially established by rotating shaft 32 to selectively position the limiting member 31. More particularly the limiting member 31 is adjusted with the set screw 35 loosened and with the indicating arm 36 in a position where it corresponds to zero force so that the shaft 32 can be selectively rotated by means of a screwdriver engaged in the slot 33 formed in the end of said shaft. By adjusting the limiting member 31 in this manner the relationship of the wheel member 12 with the needle plate 9 can be set to satisfactorily accommodate the thinnest of workpieces to be sewn.

Figure 3:
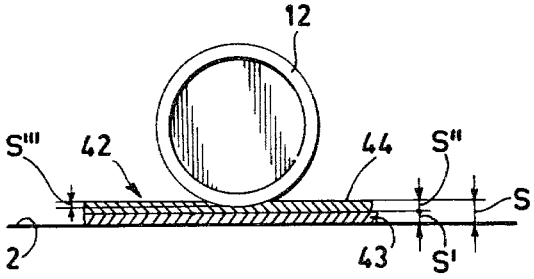
FIG. 3 is a view in side elevation and partially in section showing the relationship of the transport mechanism with the upper layer of a workpiece.

When making the initial adjustment of the limiting member 31 (FIG. 3) relative to a given thickness S of a workpiece, the operator must take into account the thickness S′ of the lower layer as well as the thickness S″ of the upper layer. This is necessary so that the thickness of the upper layer when engaged by the wheel member and which is depicted by the letter S‴ will not be compressed beyond its limitations so as to cause a marking condition, but compressed only to the extent whereby said wheel member will satisfactorily perform its intended function.

With the wide range of available settings for the wheel member 12 being known to an operator and who simply has to change the location of the indicating arm 36 on the graduated scale to obtain a different setting, it is now possible to cause said wheel member 12 to engage a series of workpieces which vary in thickness with generally the same degree of downward force acting on each workpiece.

Although the present invention has been described in connection with a preferred embodiment, it is to be understood that modifications and variations may be resorted to without departing from the spirit and scope of the invention as those skilled in the art will readily understand. Such modifications and variations are considered to be within the purivew and scope of the invention and the appended claims.

I claim:

1. A regulating device for the workpiece transport mechanism in sewing machines having a needle and presserfoot disposed in the machine's sewing zone and of the type for joining a plurality of layers of material forming the workpiece, said regulating device comprising:

(a) a tubular support (14) pivotably attached to the sewing machine;

(b) a rotatably driven shaft (13) mounted in and extending from said tubular support including:

(i) a wheel member (12) fixed on the end of said driven shaft (13) extending from said tubular support (14);

(c) biasing means (19) operatively connected to said tubular support (14) for urging the latter in a direction to effect engagement of said wheel member (12) with the upper layer of the workpiece; and (d) regulating means (26) operatively associated with said tubular support (14) including:

(i) a body portion (27) forming a support structure attached to the machine;

(ii) a limiting member (31) defining an eccentric roller mounted for rotative movement within said body portion (27) in operative engagement with said tubular support (14); and (iii) means for rotating said limiting member (31) to any one of a plurality of fixed positions for selectively changing the operating position of said wheel member (12) to accommodate workpieces of different thicknesses.

2. The structure according to claim 1 wherein said rotating means includes:

(a) an indicating arm (36) operatively connected to and extending from said limiting member (31) including:

(i) a laterally extending detent (38) fixed on the free end thereof; (b) an arcuated plate member (39) operatively associated with said indicating arm (36) including:

(ii) a plurality of stops defining holes (41) evenly spaced along its length for selectively locating said detent (38) in anyone thereof.

3. The structure according to claim 2 wherein said indicating arm (36) is fabricated from a manually flexible material.

4. The structure according to claim 3 wherein said indicating arm (36) includes a knob (37) fixed on the free end thereof in axially alignment with said detent (38).

* * * * *